US005841368A

United States Patent [19]

Bryant

[11] Patent Number: 5,841,368

[45] Date of Patent: Nov. 24, 1998

[54] DEVICE FOR POSITIONING A VEHICLE IN RELATION TO THE WALLS OF A GARAGE, AND/OR IN RELATION TO AN ADJACENT VEHICLE

[76] Inventor: Jim Samuel Bryant, 2876 SE. Fairway West, Stuart, Fla. 34997

[21] Appl. No.: 378,494

[22] Filed: Jan. 26, 1995

[30] Foreign Application Priority Data

Mar. 31, 1994 [CA] Canada ..... 2120412

[51] Int. Cl.[6] ..... B60Q 1/08

[52] U.S. Cl. ..... 340/932.2; 340/940; 340/404.1

[58] Field of Search ..... 340/932.2, 665, 340/666, 940, 404.1; 116/98, 139

[56] References Cited

U.S. PATENT DOCUMENTS

| | | | |
|---|---|---|---|
| 2,371,909 | 3/1945 | Naerbo | 340/940 |
| 3,319,222 | 5/1967 | Grant et al. | 340/940 |
| 3,530,432 | 9/1970 | Pope | 340/940 |
| 3,900,830 | 8/1975 | Peterson | 340/940 |
| 3,949,355 | 4/1976 | Newmeyer | 340/940 |
| 3,950,725 | 4/1976 | Kitajima | 340/940 |
| 4,641,870 | 2/1987 | Heyman | 293/102 |
| 4,742,327 | 5/1988 | Burgess et al. . | |
| 4,977,400 | 12/1990 | Jeffries | 340/932.2 |
| 5,126,735 | 6/1992 | Trevijano . | |
| 5,297,477 | 3/1994 | Phillips | 99/495 |
| 5,341,132 | 8/1994 | Dorey et al. | 340/932.2 |
| 5,546,075 | 8/1996 | Shimoji | 340/666 |

FOREIGN PATENT DOCUMENTS

| | | | |
|---|---|---|---|
| 4-308992 | 10/1992 | Japan | 116/98 |
| 5-242373 | 9/1993 | Japan | 116/98 |

*Primary Examiner*—Jeffery Hofsass
*Assistant Examiner*—Julie B. Lieu
*Attorney, Agent, or Firm*—Neil H. Hughs; Ivor M. Hughes; Marcelo K. Sarkis

[57] ABSTRACT

The invention is directed toward a parking assist device which is removably affixed in relation to a surface and is adapted to engage the on coming wheels of a vehicle and provide upon being engaged by the wheels of a vehicle a signal to the operator to stop the vehicle. The signal may be produced by a mechanical, electrical or other means.

9 Claims, 6 Drawing Sheets

DEVICE FOR POSITIONING A VEHICLE IN RELATION TO THE WALLS OF A GARAGE, AND/OR IN RELATION TO AN ADJACENT VEHICLE

FIELD OF INVENTION

This invention relates to a device which lays flat on the floor of a garage and may be moved to the desired location which is engagable with a tire of a vehicle and upon engagement thereof produces an audible sound or signal to alert the driver that the driver has reached the predetermined location.

BACKGROUND OF THE INVENTION

A number of devices exist in the prior art which provide a signal to the driver when the driver has reached a predetermined location. Most of the devices which Applicant has become aware of are relatively expensive and difficult to install. The following therefore represents a list of the patents which Applicant is presently aware of:

U.S. Pat. No. Design 314,938, U.S. Pat. No. 3,219,972, U.S. Pat. No. 3,872,820, U.S. Pat. No. 4,288,777, U.S. Pat. No. 4,813,758, U.S. Pat. No. 5,177,479, U.S. Pat. No. 5,208,586 and U.S. Pat. No. 5,231,392. U.S. Pat. No. 4,742,327, provides a system to activate the horn of a vehicle under certain conditions. U.S. Pat. No. 5,126,735 teaches the use of transceivers for communicating back and forth between devices within vehicles. These references are hereby incorporated by reference in relation to their aforementioned teachings.

No where in the prior art is there provided a simple parking assisting device which lies flat under a vehicle and may be moved from time to time or from place to place.

It is therefore an object of this invention to provide a device which is placed flat on a garage floor or the like and which is activated by the tires of a vehicle when the device is engaged by the tires.

It is another object of this invention to provide a device which is inexpensive and easily moved from place to place.

Further on other objects of this invention will become apparent to those skilled in the art when considering the following summary invention and the more detailed description of the preferred embodiment illustrated herein.

SUMMARY OF THE INVENTION

According to one aspect of the invention there is provided a portable vehicle parking assistance device for resting upon a surface, upon which a vehicle travels, comprising:

The parking guide includes a pre-established circuit including a switch in the base to remotely actuate the horn of a vehicle when a tire engages the guide, thereby closing the switch and the circuit and remotely actuating said horn, using the same remote actuating system used in security systems for vehicles.

a gas filled flexible body having two sides and a front, the body for removable positioning on said surface, said body for engaging a tire of a vehicle being parked proximate its front, the body being placed proximate a predetermined position on said surface so as to ensure the vehicle is not damaged, the body having disposed therewith and preferably proximate at least one side thereof a signaling device responsive to a compressive force of the tire against the body forcing the gas to pass the signaling device and thereby effect an audible signal once the vehicle has reached the predetermined position, whereby when a tire of said vehicle comes into contact with said flexible body, the audible signal will alert the driver of the vehicle that the tire of the vehicle has contacted said flexible body and the driver must stop or risk damaging the vehicle. In a preferred embodiment the gas is air. In one embodiment the body includes a venting relief valve to allow for air to pass back into the body once the tire is removed from the body.

According to yet another aspect of the invention there is provided a vehicle parking guide for use on a supporting surface disposed in a preselected travel path, comprising:

a moveable base adapted to position relative to said supporting surface;

the positioning of said base to coincide with said pre-selected travel path as a vehicle wheel approaches said base;

an enunciating means associated with said base for providing a signal to a driver when said wheel engages said base to ensure proper vehicle positioning to coincide with a pre-selected stopping point. In one embodiment the base is removably engaged with the supporting surface by suction devices such as suction cups. In another embodiment the enunciating means is an electrical actuator enunciating means. In another embodiment the enunciating means is a mechanical enunciating device. In another embodiment a switch is provided in the base to actuate the horn of a vehicle, for example using the same remote actuating system used in security systems for vehicles today. And yet another embodiment a double sided tape is used to secure Velcro strips to the garage floor which engage the base.

In essence therefore the invention is directed toward a device which is removably affixed in relation to a surface and is adapted to engage the on coming wheels of a vehicle and provide upon being engaged by the wheels of a vehicle a signal to the operator to stop the vehicle. The signal may be produced by a mechanical, electrical or other means. To this end therefor there is provided a parking assist device comprising means for removably affixing said device in relation to a surface, said device having means to engage the on coming wheels of a vehicle and signalling means, wherein when the device is engaged by the wheels of a vehicle said signalling means will produce a signal to the operator to stop the vehicle.

DETAILED DESCRIPTION OF PREFERRED EMBODIMENTS OF THE INVENTION

Figure 1:
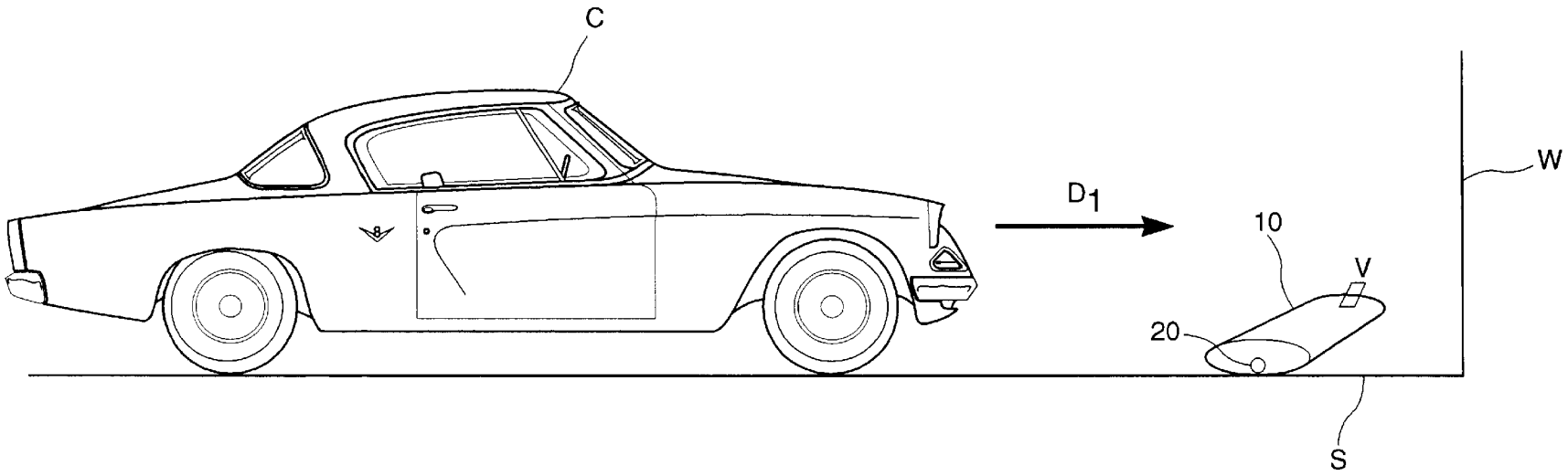
FIG. 1 is a schematic view of a vehicle approaching the signaling device.

Referring now to FIG. 1, there is illustrated a vehicle C moving into a garage having a surface S and a back wall W. It also has side walls (not shown). The rest of the garage is not shown. The vehicle C therefore moves in a direction D1 toward an enunciating device 10 which produces a signal through a whistle port 20. The body 10 is an air filled body at ambient pressure which can be readily pressed to force air through the enunciating opening 20 and when not pressed to allow air to re-enter the body 10 via vent V.

Figure 2:
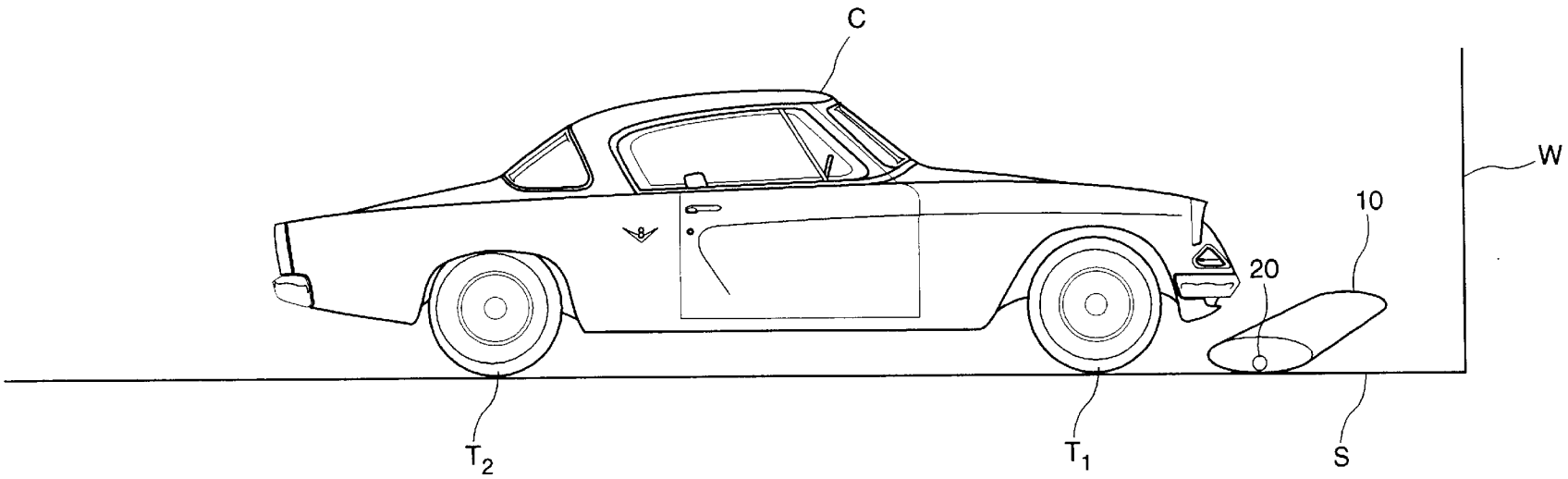
FIG. 2 is the vehicle nearing the rear wall of a garage.

The vehicle as shown in FIG. 2 therefore approaches the body 10 which lays across the path of the vehicle below the level of the vehicle and which will not engage any portion of the vehicle other than the tires. In the embodiment shown an enunciating device will provide a signal whether the front right of the front left or both press the device. The body therefore is made from fairly ridged rubber or plastic which can take the weight of a vehicle and which can readily bounce back to its original shape.

Figure 3:
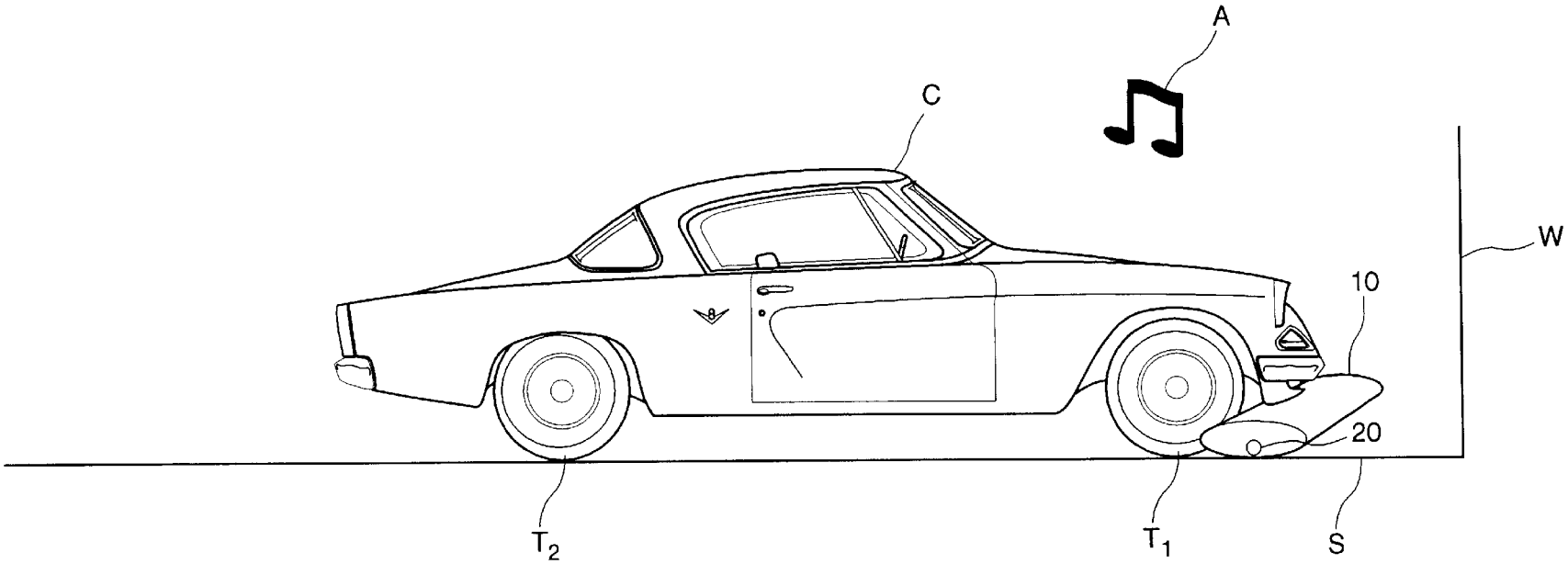
FIG. 3 is the vehicle engaging the signaling device.

As best seen in FIG. 3 when the front tire T1 touches the device 10 so as to cause air to pass through the hole 20 then a audible signal A will be produced for vehicle C's operator, to let the operator know he has reached the pre-selected position. Of course, before parking the vehicle in a garage the owner would place the removable device at any pre-desired location and may fasten the device to the garage for using Velcro, suction cups, double sided tape or the like.

Figure 4:
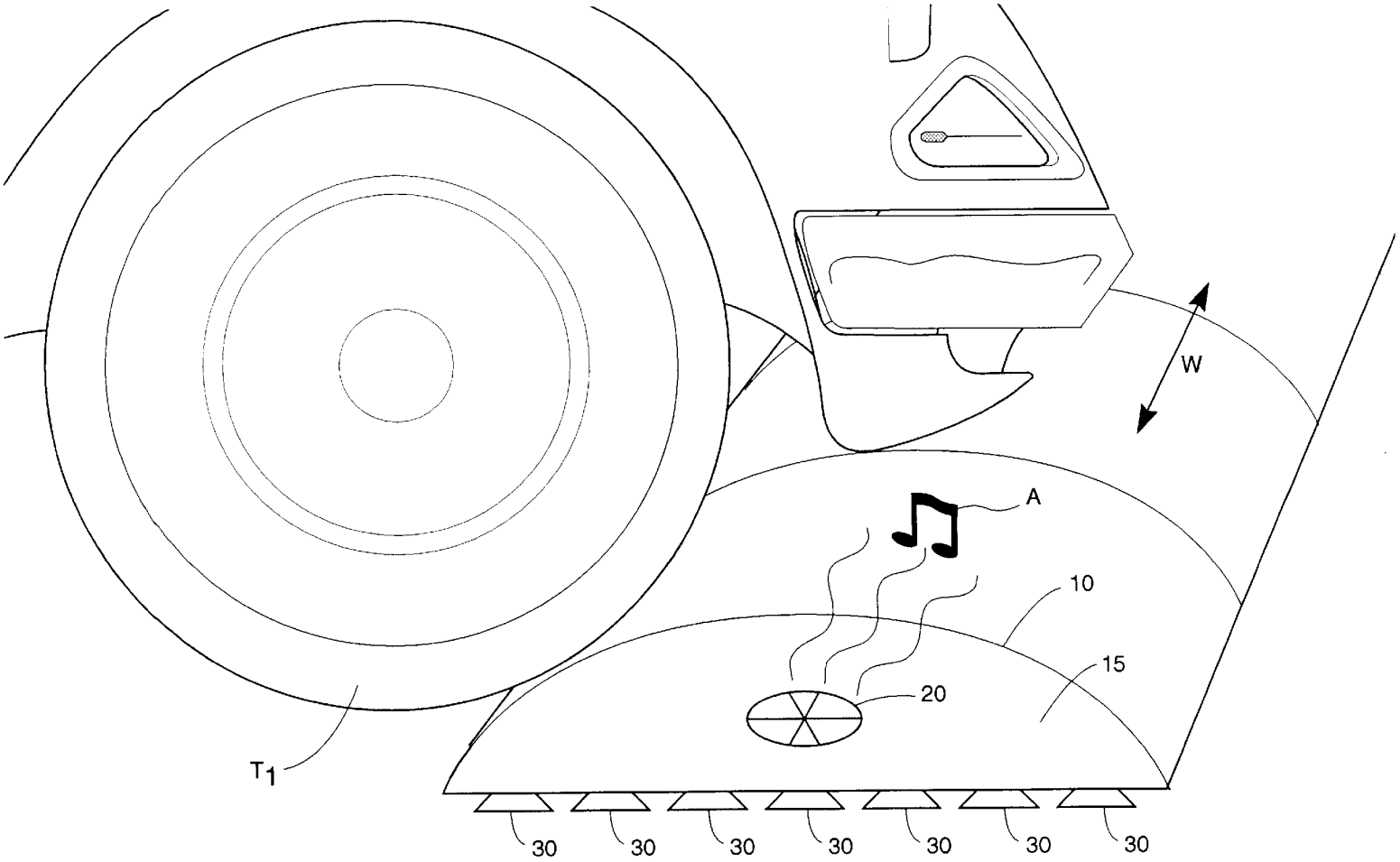
FIG. 4 is the tire of the vehicle engaging the signaling device in closer perspective.

As best seen in FIG. 4 the tire T1 therefore engages the device 10 and compresses the front edge portion of the device 10 so that the air filled compartment 15 forces air through the whistle or signaling device 20 causing the audible signal A to be heard by the operator of the vehicle C. The tire T1 when removed from the device allows air to return back into the compressible device via a vent, as seen in FIG. 1. The device extends substantially across the full width of the vehicle W so that either tire may first engage the device. Suction cups 30 are provided in FIG. 4 to secure the device to the floor.

Figure 5:
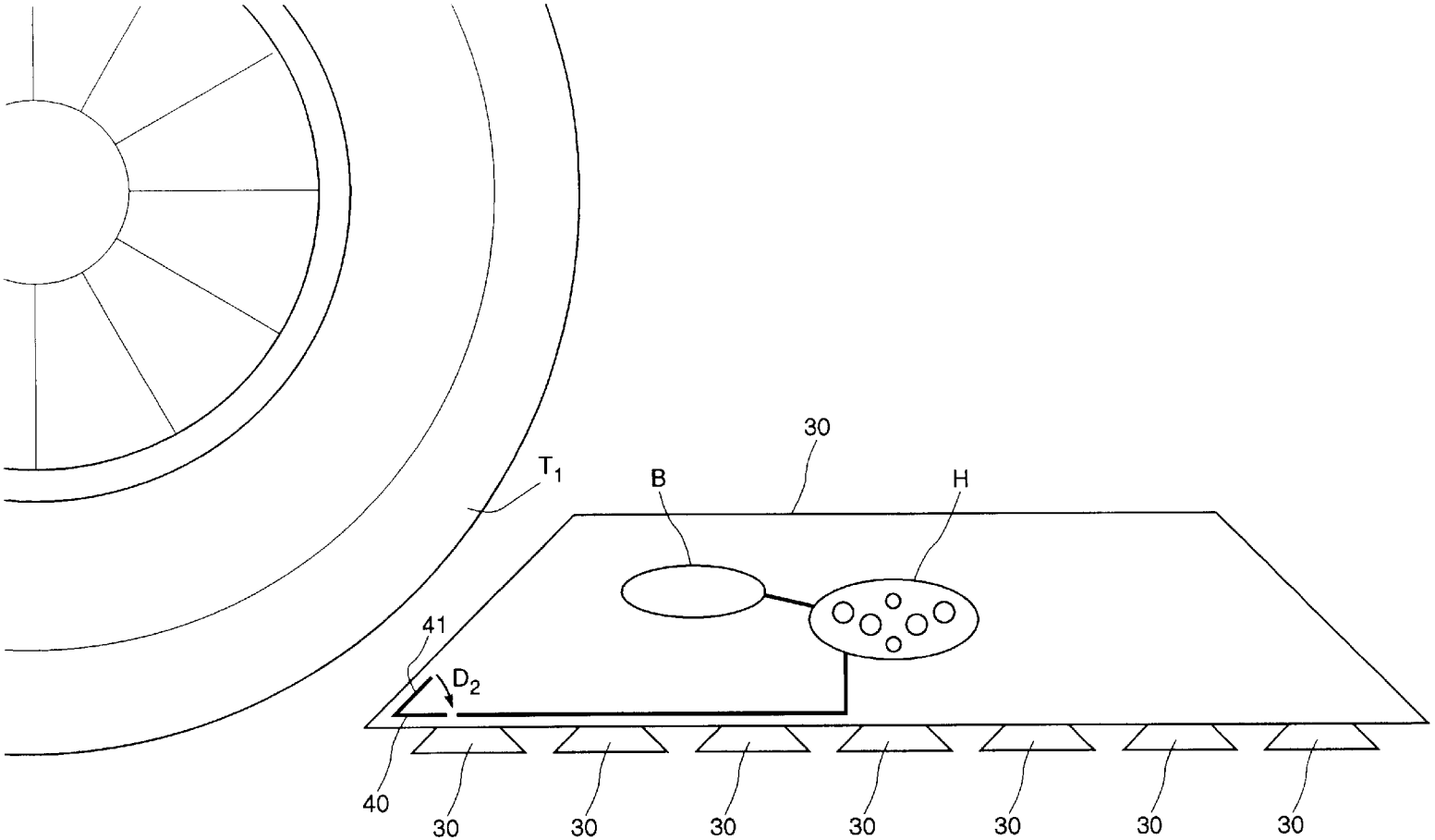
FIG. 5 is an alternative embodiment of the signaling device.

Referring now to FIG. 5 there is shown an alternative embodiment of the invention that an a electrical device powered by a removable battery contained within compartment B containing the batteries (not shown), which via a pre-established circuit allows the pressing of the portion or switch plate 41 to engage with switch plate 40 in a direction D2 and thus closing the circuit as tire T1 engages the device 30, and therefore activating the horn H providing the audible signal to the occupant of the vehicle C. The battery and horn may also be located on a garage wall with connecting wires attached to the enunciating device which wires lay flat on the garage floor and are covered by duct tape or the like. Any signaling device may be used. In another embodiment not illustrated, a mechanical grinding device which causes a rasping or grinding of one body against another body is provided when the tire engages the device.

Figure 6:
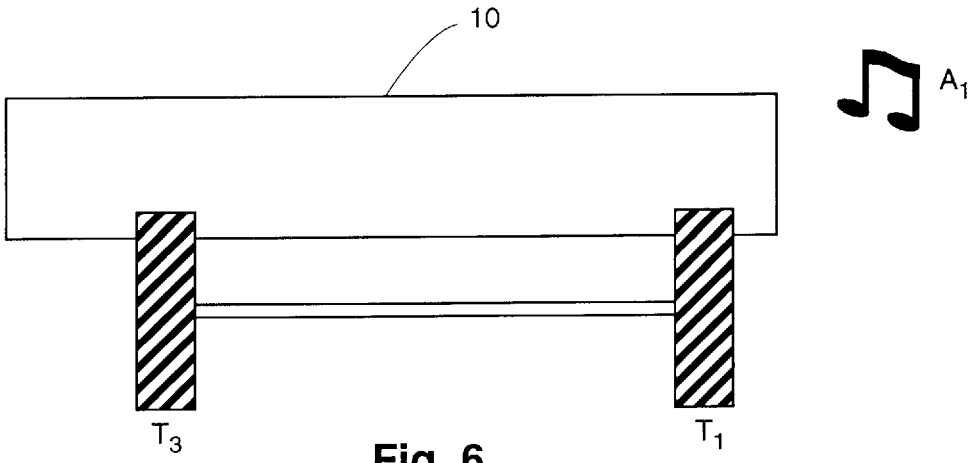
FIG. 6, 7 and 8 referred to various positions of the tires in relation to the device.
Figure 7:
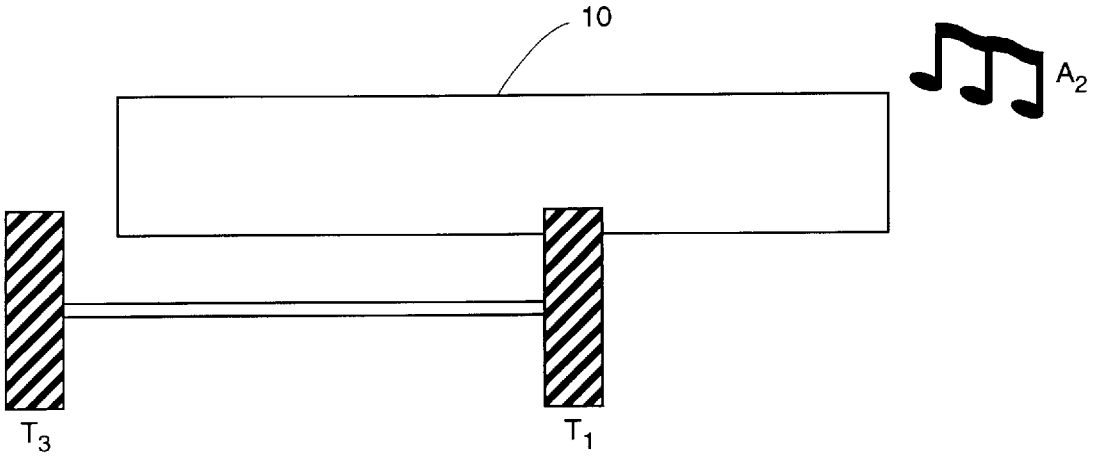
Figure 8:
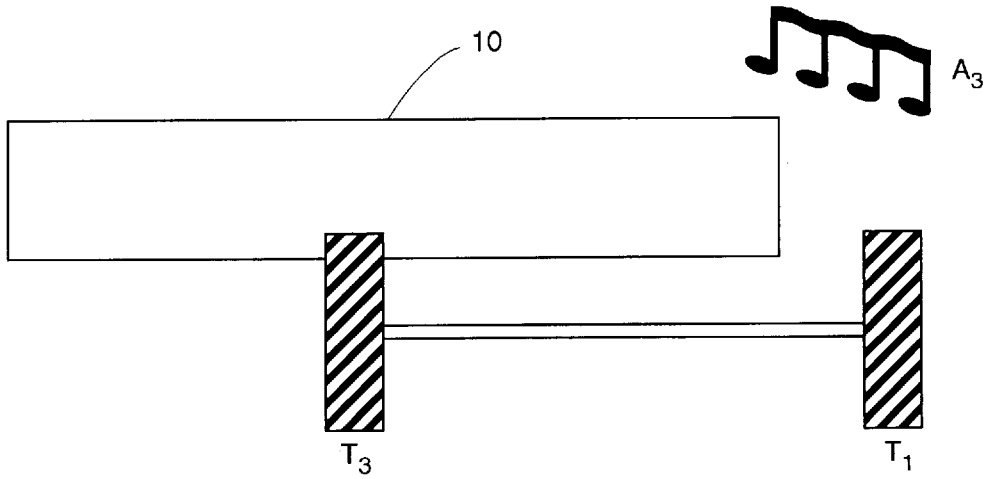

In another embodiment as seen in FIGS. 6, 7, and 8 similar to FIG. 1 and where there are other vehicles parked adjacent the vehicle in question on both sides thereof, an alternative structure may be provided which produces a different alerting signal, types $A_1$, $A_2$, and $A_3$ when the left tire only or the right tire only engage the device. In this embodiment if the vehicle were approaching a parking position too far to the left, the right tire only would engage the device producing a first audible signal type letting the driver know he is to far to the one side. If the driver were too far to the other side a second signal type would sound, different from the first signal. Finally, if the vehicle were approaching just right, then a third signal type would sound indicating to the driver that he is in the correct position in relation to the rear wall of a garage, and the side walls of the garage and/or other vehicles. In another alternative embodiment of the invention the audible signals may be tones. For example, a "raspberry" tone when an incorrect position is reached and "pleasant" tone when the correct position is reached.

As many changes can be made to the invention without departing from the scope of the invention, it is intended that all material contained herein be interpreted as illustrative of the invention and not in a limiting sense.

The embodiments of the invention in which an exclusive property or privilege is claimed are as follows:

1. A self-contained portable vehicle parking assistance device for resting upon a surface, upon which a vehicle travels, comprising:

an air filled flexible portable body having an exterior, two sides, a front and an interior containing the air at ambient pressure, the body for removable positioning on said surface, said body extending the full width of a vehicle and for engaging at least one tire of a vehicle being parked proximate the front of the body, the body being placed proximate a predetermined position on said surface so as to ensure the vehicle is not damaged while parking or when parked, the body having disposed therein extending from the interior to the exterior of the body a signaling device responsive to a compressive force of the at least one tire against the body forcing the air to pass through the signaling device from the interior to the exterior of the body and thereby effect an audible signal once the vehicle has reached the predetermined position, said signaling device being capable of producing at least two different types of audible signals, one signal type indicates when both tires are positioned correctly at the predetermined position and the vehicle is centered, and a different signal type indicates when only one tire has engaged the device and the vehicle is off center, whereby when at least one tire of said vehicle comes into contact with said flexible body, the audible signal will alert the driver of the vehicle that the at least one tire of the vehicle has contacted said flexible body and the driver must stop or risk damaging the vehicle and further that the vehicle is centered in the predetermined position.

2. The device of claim 1 wherein the signaling device is disposed proximate at least one side of the gas filled flexible body.

3. The device of claim 1, or 2, wherein the body includes a venting relief valve to allow for air to pass back into the body once the tire is removed from the body.

4. A portable self-contained vehicle parking guide for use on a supporting surface in a pre-selected travel path, comprising:

a moveable portable base adapted to extend the full width of a vehicle and to be positioned relative to said supporting surface;

the positioning of said base to coincide with said pre-selected travel path as at least one vehicle wheel approaches said base;

an enunciating means disposed within said base for providing at least two different types of audible signals to a driver when said at least one wheel engages said base to ensure proper vehicle positioning and centering to coincide with a pre-selected stopping point, one signal type indicates when both wheels are positioned correctly at the preselected stopping point and that the vehicle is centered, and a different signal type indicates when only one wheel has engaged the device and the vehicle is off center and means disposed within said base to substantially simultaneously activate said enunciating means when said at least one wheel engages said base.

5. The parking guide of claim 4 wherein the base is removably engaged with the supporting surface by a suction device.

6. The parking guide of claim 4 or 5 wherein the enunciating means is an electrically actuated enunciating means, and said device to actuate said enunciating means is an electrical switch.

7. The parking guide of claim 4 or 5 wherein the enunciating means is a mechanical enunciating device.

8. A portable self-contained vehicle parking guide for use on a supporting surface disposed in a pre-selected travel path, comprising:

a moveable portable base adapted to be positioned relative to said supporting surface;

the positioning of said base to coincide with said pre-selected travel path as a vehicle wheel approaches said base;

wherein a pre-established circuit including a switch is provided in the base of the guide to remotely actuate a horn of a vehicle when a tire engages the guide, thereby closing the switch and the circuit and remotely actuating said horn, using the same remote actuating system used in security systems for vehicles, the horn of said vehicle providing a signal to a driver when said wheel engages said base to ensure proper vehicle positioning to coincide with a pre-selected stopping point.

9. A portable self-contained parking assist device comprising non-destructive means for removably affixing said device in relation to a surfaces, said device extending the full width of a vehicle and having means to engage at least one of the on-coming wheels of the vehicle, said device having disposed therein signalling means capable of producing at least two different types of signals, one signal type indicates when both wheels are positioned correctly and the vehicle is centered, and a different signal type indicates when only one wheel has engaged the device and the vehicle is off center, said signalling means being actuated by means to actuate said signalling means actuated when said parking assist device is engaged by at least one of the on-coming wheels of the vehicle, wherein when the device is engaged by at least one wheel of the vehicle said signalling means will be activated to produce a signal to the operator to stop the vehicle, and further that the vehicle is in the correct and centered.

* * * * *